US005620214A

United States Patent [19]

Kondratuk

[11] Patent Number: 5,620,214

[45] Date of Patent: Apr. 15, 1997

[54] SASH LATCH

[75] Inventor: Michael W. Kondratuk, Cameron, Wis.

[73] Assignee: Wright Products Corp., Minneapolis, Minn.

[21] Appl. No.: 12,503

[22] Filed: Feb. 2, 1993

[51] Int. Cl.[6] ..... E05C 3/06

[52] U.S. Cl. ..... 292/217; 292/223; 292/240

[58] Field of Search ..... 70/34; 292/217, 292/223, 229, 196, 240–245, DIG. 20, DIG. 47

[56] References Cited

U.S. PATENT DOCUMENTS

| | | | |
|---|---|---|---|
| 2,627,435 | 2/1953 | Borrup | 292/DIG. 20 X |
| 2,764,443 | 9/1956 | Bennett | 292/240 |
| 2,789,851 | 4/1957 | Lickteig | 292/240 X |
| 2,829,914 | 4/1958 | Peras | 292/217 |
| 2,978,757 | 4/1961 | Ammerman | 292/DIG. 20 X |
| 3,104,124 | 9/1963 | Beck | 292/280 |
| 3,622,189 | 11/1971 | Rosehitz | 292/240 |
| 3,762,751 | 10/1973 | Little | 292/196 |
| 4,068,871 | 1/1978 | Mercer | 292/223 X |
| 4,095,829 | 6/1978 | Van Klompenburg | 292/241 |
| 4,142,751 | 3/1979 | Varda | 292/217 |
| 4,869,023 | 9/1989 | Bakula et al. | 292/241 X |

FOREIGN PATENT DOCUMENTS

| | | | |
|---|---|---|---|
| 2170856 | 8/1986 | United Kingdom | 292/298 |

*Primary Examiner*—Suzanne L. Dino

*Attorney, Agent, or Firm*—Merchant, Gould, Smith, Edell, Welter & Schmidt

[57] ABSTRACT

A latch device for securely locking a keeper mounted on a window within a latch housing located on a window frame. The latch includes a locking bolt which is biased into an open position by a spring. The handle is coupled to the bolt through links. Rotation of the handle causes rotation of the bolt which captures and may lift the keeper to accommodate keeper misalignment.

11 Claims, 5 Drawing Sheets

SASH LATCH

TECHNICAL FIELD

The present invention relates generally to window latch hardware and more particularly to a sash latch for use with movable windows of the type found in houses.

BACKGROUND ART

It is conventional to mount many windows in homes so that they can be opened for ventilation. Windows mounted on vertically oriented hinges are generally referred to as "casement" windows. Windows mounted on horizontal hinges are referred to as "awning" type windows. It is conventional to provide a hand cranked winder to move the window through its range of motion from the opened to the closed position. As the window approaches the closed position a latch is usually provided to seat the window and to lock it in the closed position. Typically, a keeper attached to the window sash mates with a latch assembly which is attached to the window frame or sill. The latch captures the keeper and operation of the latch draws the window into the closed position where it is locked. In the closed position the window is seated in the frame and compresses weather stripping to seal the window assembly.

In many applications the window may sag and alignment between the keeper and the latch may vary over time. In these applications it is difficult for the latch to capture the keeper and effectively close the window.

DISCLOSURE OF THE INVENTION

The present invention discloses a latch assembly which is tolerant of keeper misalignment and which, in a preferred embodiment, may be mounted for use with either right or left handed windows.

The latch assembly includes a handle or lever which is pivotally mounted in a latch housing. A bolt is pivotally mounted in the housing as well. The handle is coupled to the bolt through a pair of links which transfer motion from the handle to the bolt. The bolt itself has a complex shape and includes several specialized surfaces. Some surfaces are adapted to mate with the keeper and to lift it to compensate for window sag. Other surfaces catch or capture the keeper to draw the keeper into the latch housing during bolt rotation. Another surface serves to "kick-out" the keeper during extreme bolt rotation in the unlock direction.

A spring is included in the latch assembly. In the "unlocked" position the spring biases the bolt into an open position which effectively increases the reach of the latch and which makes the latch tolerant of keeper misalignment. In the "locked" position the spring helps to prevent rattling of the handle and the keeper.

When the handle is moved to rotate the bolt, the bolt captures, lifts and draws the keeper into the latch housing. When the handle is moved to its extreme position the latch assumes a "locked" position. In the "locked" position the linkage between the bolt and handle is tensioned and forms an over-center toggle to retain the window in the closed position.

DESCRIPTION OF THE DRAWINGS

An illustrative embodiment of the invention is shown in the various figures, in which identical references indicate identical structure throughout and wherein.

MODE FOR CARRYING OUT THE INVENTION

Figure 1:
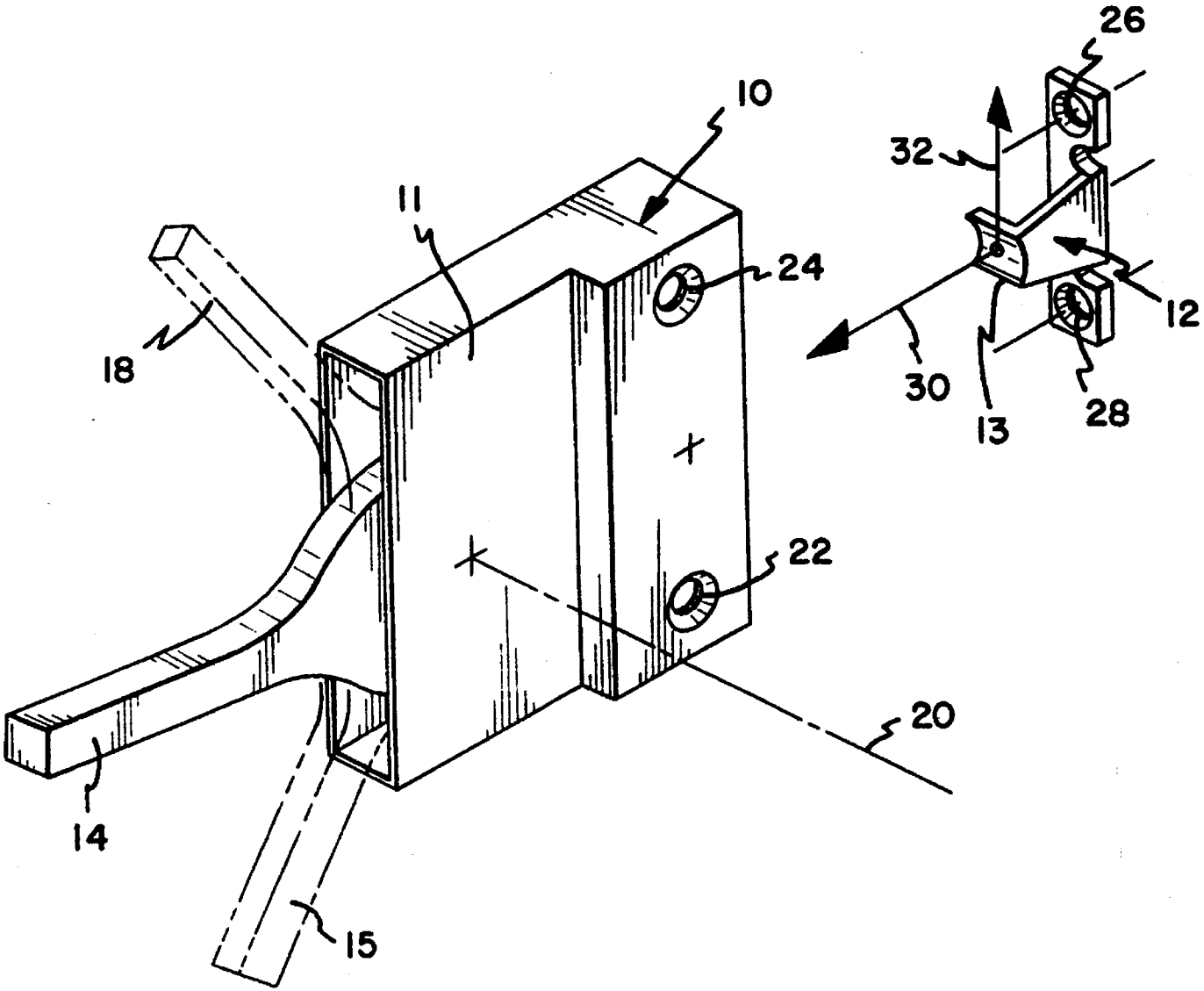
FIG. 1 is a perspective view of the latch and keeper.

FIG. 1 shows a perspective view of the latch assembly 10 and the complimentary keeper 12. In a typical application, the keeper 12 will be mounted on a window casement by the placement of mounting screws through mounting aperture 26 and mounting aperture 28. The latch assembly 10 will be mounted on a window frame or sill through the use of mounting aperture 22 and mounting aperture 24. In use, the window is hinged so that the keeper 12 can move along a closure path 30 toward the latch assembly 10 as the window is closed.

When the keeper 12 is adjacent the latch assembly 10, the latch handle 14 can be rotated about handle axis 20 into a "locked" position 15 shown in phantom outline in FIG. 1, from the "open" position 18 shown in phantom outline in FIG. 1. Movement of the handle 14 from the "open" position to the "locked" position causes the so called "bolt" to rotate and to capture the keeper 12. This process causes the keeper 12 to be lifted in the vertical direction indicated by the lifting path arrow 32 and to be pulled into the latch housing 11 as indicated by the closure path arrow 30. This movement of the bolt closes the window and supplies sufficient force to the window to provide a good seal against weather stripping.

In a similar fashion, movement of the handle 14 from the "locked" position 15 to the "open" or unlocked position 18 releases the keeper 12. A kick-out surface on the bolt interacts with the keeper hook 13 and forces the keeper 12 out of the latch.

In the preferred embodiment both the latch assembly 10 and the keeper 12 are symmetrical and they may be mounted for use with right handed or left handed windows. However in order to economize on the cost of production it is possible to eliminate one of the two links forming complimentary right and left handled latch assemblies. It is common to die cast latch components out of zinc or aluminum, although certain components may be stamped from mild steel or the like. In general, materials choices are not critical to the operation of the latch. The optimum material choice will depend upon balancing durability and cost considerations.

Figure 2:
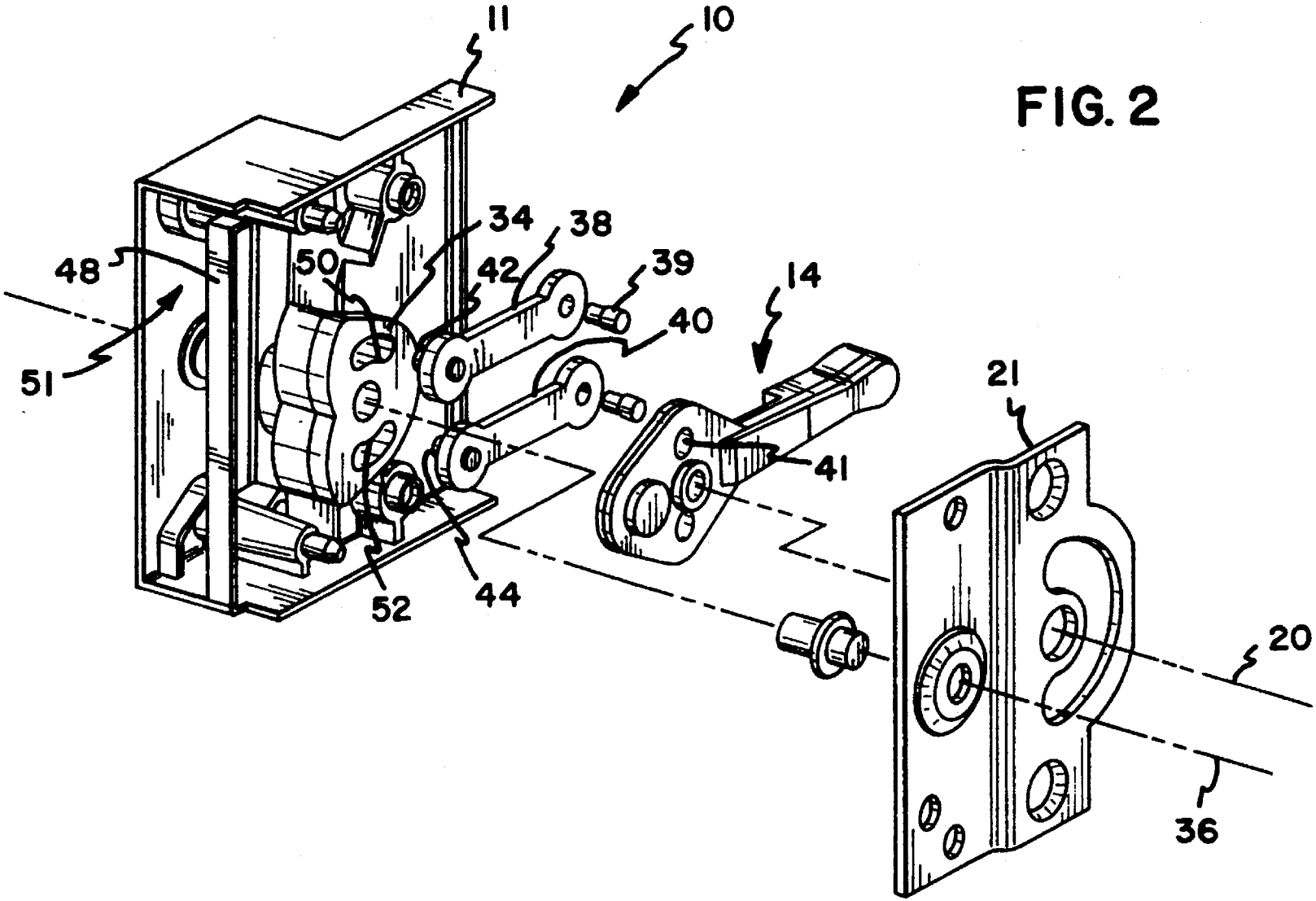
FIG. 2 is an exploded view of the latch assembly.

FIG. 2 is an exploded view of the latch assembly 10. This view shows an outer latch housing 11 and an inner latch housing plate 21. The interior portion of the handle 14 is visible in the figure. This portion of the handle 14 is mounted for pivotal rotation around a handle axis 20. The bolt 34 is also shown and it is mounted for pivotal rotation about a bolt axis 36. First link 38 and second link 40 are also shown. These links connect the handle 14 to the bolt 34. First link 38 has a journal 39, which mates with a corresponding journal aperture 41, located in the handle 14. An upper link pin 42 is fitted in the first link 38, to communicate with an arcuate first link pin slot 50, located in the bolt 34. In a similar fashion, the second link 40 carries a link pin 44, which mates with an arcuate second link pin slot 52, formed in bolt 34. The outer housing 11 carries a pair of spring retention features, one of which can be seen in FIG. 2 and is identified by reference numeral 51. The leaf spring 48 is shown nested in the retention features.

Figure 3:
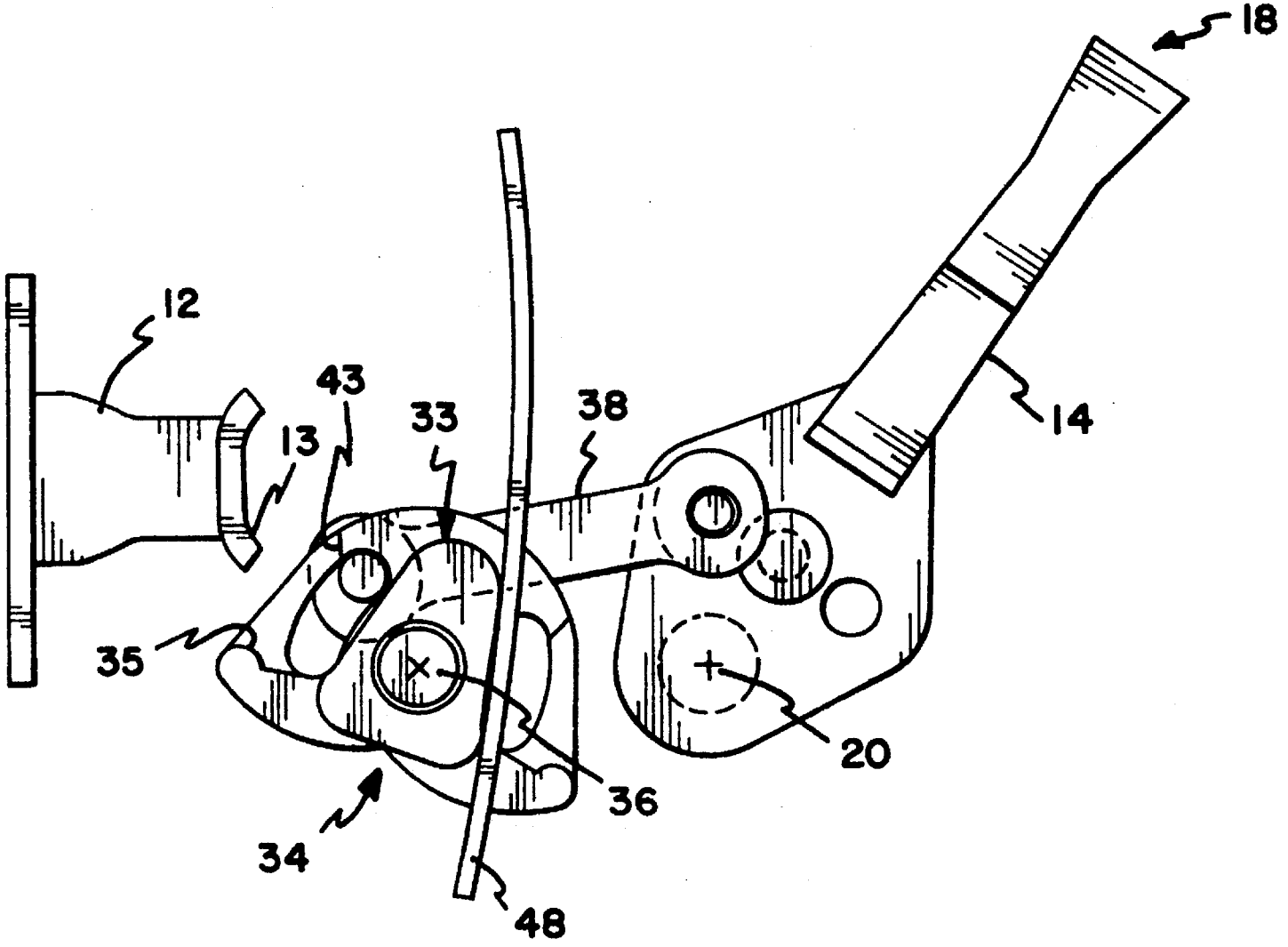
FIG. 3 is schematic view of several elements of the latch assembly.
Figure 4:
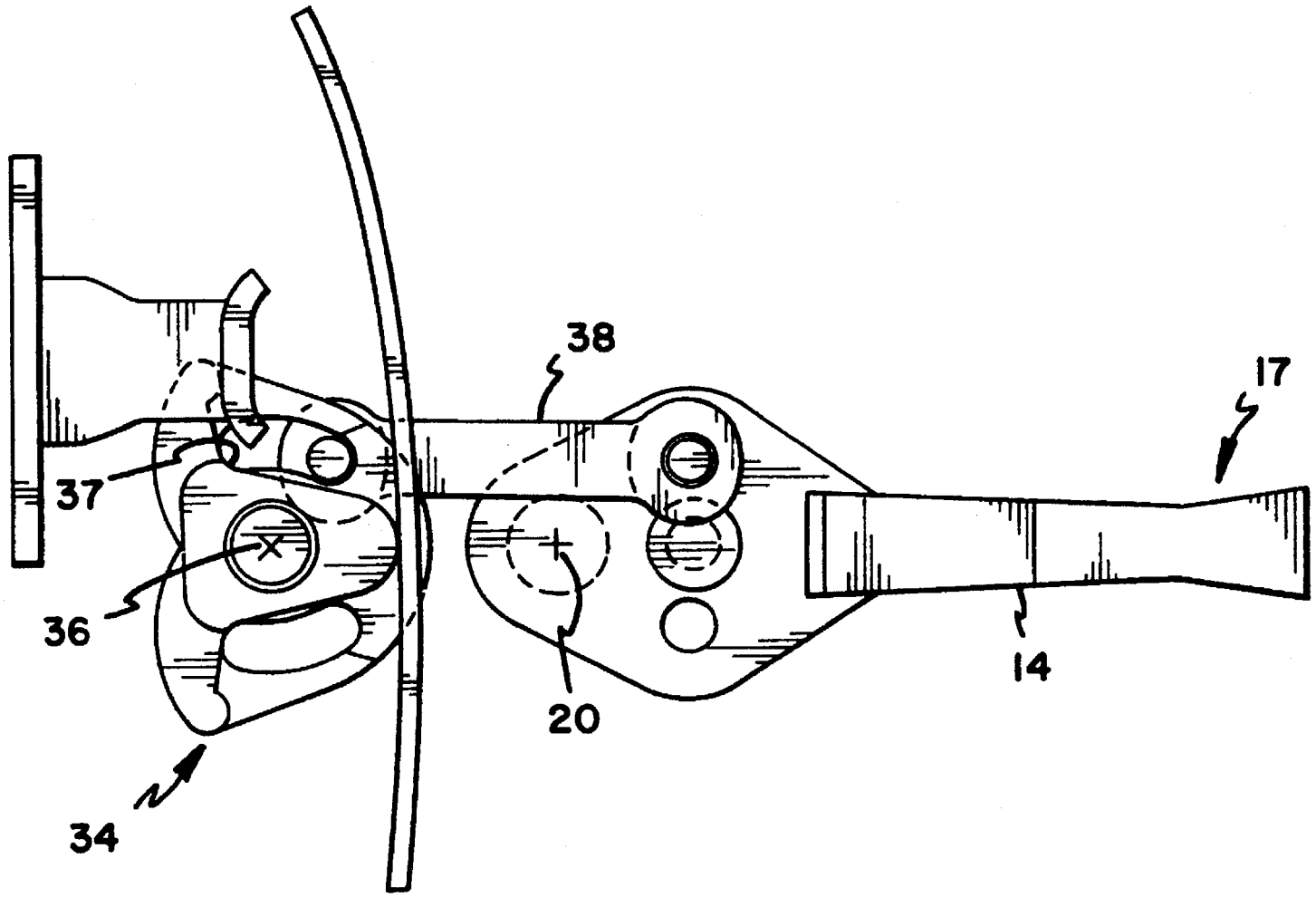
FIG. 4 is schematic view of several elements of the latch assembly.
Figure 5:
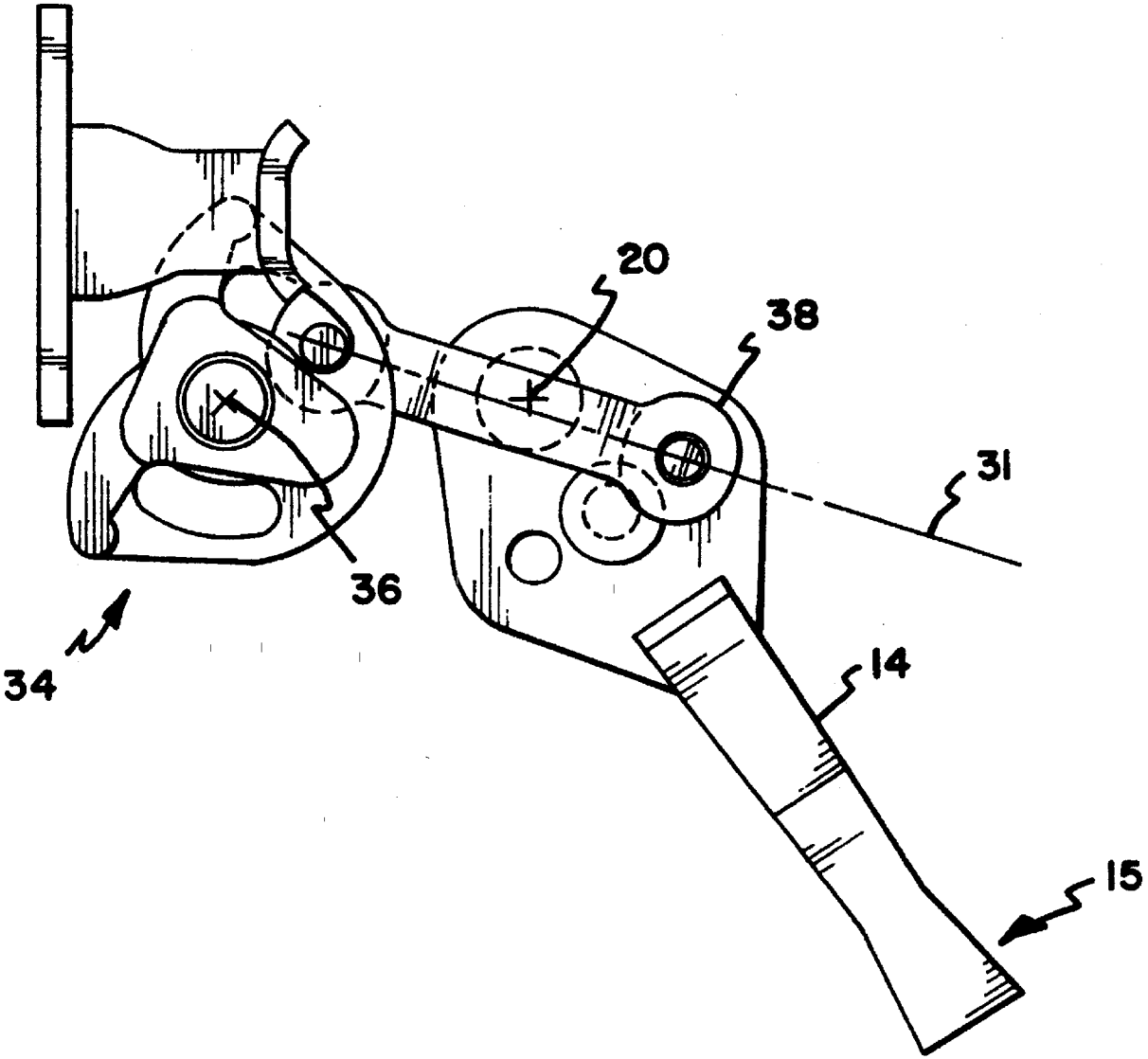
FIG. 5 is schematic view of several elements of the latch assembly.

FIG. 3, FIG. 4 and FIG. 5 should be considered together. These figures show the handle 14, the bolt 34 and one of the links 38 in a variety of positions. For clarity the housing and lower link are not shown in these views.

FIG. 3 corresponds to the handle 14 in the unlocked position 19. In this view the bolt 34 is fully rotated in the counterclockwise direction to the "open" position to capture the keeper 12. The bolt 34 includes a hook shaped pulling surface 35 which is positioned beneath the keeper hook 13 in the figure. In this position the spring 48 is in its minimum energy state and it biases the bolt 34 in the fully counterclockwise direction. As shown in the figure the bolt 34 includes a cam surface 33 which abuts the spring 48. In this unlocked position 19 the spring 48 provides a force to maintain the bolt 34 in the fully rotated position. This permits substantially more bolt 34 rotation than would be possible with the links alone. This increases the capture range of the bolt and thus contributes to the ability of the latch to accommodate a misaligned keeper. FIG. 3 also depicts the kick-out surface 43 which is located on the bolt 34. If the window sticks, the handle 14 and link 38 move the kick-out surface into abutment with the keeper hook 13 and force the keeper 12 away from the latch.

FIG. 4 shows the handle 14 rotated to the intermediate position 17. In this position the cam surface 33 has deflected the spring in to its maximum energy state and the spring is resting on a cam nose detent surface 29. During manufacture this handle position is used as an aid to painting the latch assembly. In use, the handle 14 lever pulls on the first link 38 which in turn causes the first link pin 42 to abut the end of the first link pin slot 50 to rotate the bolt 34 into this intermediate position. It is important to note that the bolt 34 includes a keeper lifting surface 37 which will bottom out on a sagging keeper hook as the keeper 12 is drawn into the latch housing 11. In FIG. 3 this keeper lift surface 37 lies somewhat below the bolt axis 36, while in FIG. 4 the surface 37 lies above the bolt axis. Consequently if the keeper hook 13 has sagged it will be lifted during bolt 34 rotation which typically facilitates window closure.

FIG. 5 shows the latch assembly in locked position 15. In this figure the keeper 12 is drawn into the locked position 15 by bolt 34 rotation. The handle 14 is connected to the bolt 34 through the first link 38. As seen in the figure the centerline 31 of the first link 38 is located below the handle axis 20 in this locked position. By positioning the centerline 31 below the handle axis 20 results in an over-center toggle action and forces supplied to the bolt 34 which tend to force the bolt 34 to rotate in the counterclockwise direction tend to move the handle 14 in the clockwise direction. This action causes the latch assembly to latch firmly and to resist being pried open.

What is claimed is:

1. A sash latch assembly for use with a movable window having a window sash and a window sill, said latch assembly comprising:

a keeper mounted on said window:

a latch housing mounted on said window sill;

a handle mounted within said latch housing for rotation about a handle axis between an unlocked position and a locked position;

a bolt mounted within said latch housing for rotation about a bolt axis;

said bolt having a cam surface and a keeper pulling surface, wherein rotation of said bolt contacts said keeper with said keeper pulling surface, moving said keeper into said latch housing when said handle is moved into said locked position;

link means for connecting said handle to said bolt and for converting rotational motion of said handle to rotational motion of said bolt; and a spring fixedly held within said latch housing such that, when said handle is rotated to said unlocked position said spring abuts said cam surface so as to maintain said bolt in a fully rotated position, thereby increasing the range within which said bolt can capture said keeper; and wherein said bolt further includes a lifting surface for contacting said keeper, whereby rotation of said bolt contacts said keeper lifting said keeper and moving said keeper into said latch housing when said handle is moved into said locked position.

2. The latch assembly of claim 1, wherein said cam surface of said bolt includes a detent surface which abuts said spring when said spring is at its maximum energy state and an adjacent stabilizing surface which abuts said spring when said spring is at its minimum energy state, said minimum energy state corresponding to said fully rotated position of said bolt.

3. A sash latch assembly for use with a movable window having a window sash and a window sill, said latch assembly comprising:

a keeper mounted on said window:

a latch housing mounted on said window sill;

a handle mounted within said latch housing for rotation about a handle axis between an unlocked position and a locked position;

a bolt mounted within said latch housing for rotation about a bolt axis;

said bolt having a cam surface and a keeper pulling surface, wherein rotation of said bolt contacts said keeper with said keeper pulling surface, moving said keeper into said latch housing when said handle is moved into said locked position;

link means for connecting said handle to said bolt and for converting rotational motion of said handle to rotational motion of said bolt; and a spring fixedly held within said latch housing such that, when said handle is rotated to said unlocked position said spring abuts said cam surface so as to maintain said bolt in a fully rotated position, thereby increasing the range within which said bolt can capture said keeper; and wherein said bolt further includes a kick-out surface for contacting said keeper, whereby rotation of said bolt contacts said keeper expelling said keeper from said latch housing when said handle is moved into said unlocked position.

4. The latch assembly of claim 3, wherein said cam surface of said bolt includes a detent surface which abuts said spring when said spring is at its maximum energy state and an adjacent stabilizing surface which abuts said spring when said spring is at its minimum energy state, said minimum energy state corresponding to said fully rotated position of said bolt.

5. A sash latch assembly for use with a movable window having a window sash and a window sill, said latch assembly comprising:

a keeper mounted on said window:

a latch housing mounted on said window sill;

a handle mounted within said latch housing for rotation about a handle axis between an unlocked position and a locked position;

a bolt mounted within said latch housing for rotation about a bolt axis;

said bolt having a cam surface and a keeper pulling surface, wherein rotation of said bolt contacts said keeper with said keeper pulling surface, moving said keeper into said latch housing when said handle is moved into said locked position;

link means for connecting said handle to said bolt and for converting rotational motion of said handle to rotational motion of said bolt; and a spring fixedly held within said latch housing such that, when said handle is rotated to said unlocked position said spring abuts said cam surface so as to maintain said bolt in a fully rotated position, thereby increasing the range within which said bolt can capture said keeper; and wherein said link means comprises a first link and a second link pivotally mounted in said handle.

6. The latch assembly of claim 5, wherein said cam surface of said bolt includes a detent surface which abuts said spring when said spring is at its maximum energy state and an adjacent stabilizing surface which abuts said spring when said spring is at its minimum energy state, said minimum energy state corresponding to said fully rotated position of said bolt.

7. A sash latch assembly for use with a movable window having a window sash and a window sill, said latch assembly comprising:

a keeper mounted on said window;

a latch housing mounted on said window sill;

a handle mounted within said latch housing for rotation about a handle axis;

a generally symmetric bolt mounted within said latch housing for rotation about a bolt axis between an unlocked position and a locked position, said bolt having first and second keeper pulling surfaces on opposite sides of said bolt, each of said pulling surfaces being constructed and arranged to contact said keeper, pulling said keeper into said latch housing upon rotation of said bolt to said locked position; and link means for connecting said handle to said bolt and for converting rotational motion of said handle to rotational motion of said bolt;

said keeper and said latch housing being mountable in a first position wherein said first pulling surface pulls said keeper to said locked position upon clockwise rotation of said bolt, and a second position wherein said second pulling surface pulls said keeper to said locked position upon counter-clockwise rotation of said bolt.

8. The latch assembly of claim 7 wherein said bolt further includes a lifting surface for contacting said keeper, whereby rotation of said bolt contacts said keeper lifting said keeper and moving said keeper into said latch housing when said bolt is rotated by said handle into said locked position.

9. The latch assembly of claim 7 wherein said bolt further includes a kick-out surface for contacting said keeper, whereby rotation of said bolt contacts said keeper expelling said keeper from said latch housing when said bolt is rotated by said handle into said unlocked position.

10. The latch assembly of claim 7 wherein said link means comprises first and second links pivotally mounted between said bolt and said handle.

11. A sash latch assembly for use with a movable window having a window sash and a window sill, said latch assembly comprising:

a keeper mounted on said window;

a latch housing mounted on said window sill;

a handle mounted within said latch housing for rotation about a handle axis between an unlocked position and a locked position;

a bolt mounted within said latch housing for rotation about a bolt axis wherein said bolt includes a keeper pulling surface and a kick-out surface;

link means for connecting said handle to said bolt and for converting rotational motion of said handle to rotational motion of said bolt;

whereby rotation of said bolt contacts said keeper and moves said keeper into said latch housing when said handle is moved into said locked position and whereby rotation of said bolt contacts said keeper and expels said keeper from said latch housing when said handle is moved into said unlocked position.

* * * * *